US009621979B2

(12) United States Patent
Bakalos

(10) Patent No.: US 9,621,979 B2
(45) Date of Patent: Apr. 11, 2017

(54) PRESSURE EQUALIZATION SYSTEMS AND METHODS

(71) Applicant: Bose Corporation, Framingham, MA (US)

(72) Inventor: Pericles Bakalos, Maynard, MA (US)

(73) Assignee: BOSE CORPORATION, Framingham, MA (US)

( * ) Notice: Subject to any disclaimer, the term of this patent is extended or adjusted under 35 U.S.C. 154(b) by 13 days.

(21) Appl. No.: 14/548,490

(22) Filed: Nov. 20, 2014

(65) Prior Publication Data

US 2016/0150310 A1 May 26, 2016

(51) Int. Cl.
*H04R 25/00* (2006.01)
*H04R 1/10* (2006.01)
*H04R 5/033* (2006.01)

(52) U.S. Cl.
CPC ..... *H04R 1/1083* (2013.01); *H04R 1/1041* (2013.01); *H04R 1/1075* (2013.01); *H04R 5/033* (2013.01); *H04R 1/1008* (2013.01); *H04R 2201/105* (2013.01); *H04R 2460/11* (2013.01)

(58) Field of Classification Search
CPC ..... H04R 1/10; H04R 1/1008; H04R 1/1041; H04R 1/1058; H04R 1/1075; H04R 1/1083; H04R 1/2826; H04R 5/033; H04R 2201/105; H04R 2201/107; H04R 2460/11; G10K 11/16; G10K 2210/1081; A61F 11/14
USPC ..... 381/71.6, 350, 351, 370, 371, 372, 373, 381/374, 376; 379/430, 431, 432; 128/864, 868
See application file for complete search history.

(56) References Cited

U.S. PATENT DOCUMENTS 4,529,057 A * 7/1985 Telford ..... A61F 11/14 128/868
7,391,878 B2 * 6/2008 Liao ..... H04R 5/033 381/370
8,199,955 B2 * 6/2012 Akino ..... H04R 1/1008 381/332
2014/0169579 A1 * 6/2014 Azmi ..... G10K 11/16 381/71.6

* cited by examiner

*Primary Examiner* — Huyen D Le
(74) *Attorney, Agent, or Firm* — Patterson + Sheridan, LLP

(57) ABSTRACT

An apparatus include an earpiece including a chamber. The chamber has a passageway. The apparatus includes a valve configured to relieve acoustic pressure in the chamber. The valve control assembly is configured to control the valve based on acoustic pressure in the chamber.

21 Claims, 9 Drawing Sheets

PRESSURE EQUALIZATION SYSTEMS AND METHODS

I. FIELD OF THE DISCLOSURE

The present disclosure relates in general to pressure equalization systems and methods.

II. BACKGROUND

A user can wear a headset to enjoy music without distracting or bothering people around them. Noise canceling headsets allow a user to listen to audio, such as music, without hearing various noises that are not part of the audio.

The presence of ambient acoustic noise in an environment can have a wide range of effects on human hearing. Some examples of ambient noise, such as engine noise in the cabin of a jet airliner, can cause minor annoyance to a passenger. Other examples of ambient noise, such as a jackhammer on a construction site, can cause permanent hearing loss. Techniques for the reduction of ambient acoustic noise are an active area of research, providing benefits such as more pleasurable hearing experiences and avoidance of hearing losses.

Some noise reduction systems utilize active noise reduction techniques to reduce the amount of noise that is perceived by a user. Active noise reduction (ANR) systems can be implemented using feedback approaches. Feedback-based ANR systems typically measure a noise sound wave, possibly combined with other sound waves, near an area where noise reduction is desired (e.g., in an acoustic cavity such as an ear cavity). In general, the measured signals are used to generate an "anti-noise signal," which is a phase inverted and scaled version of the measured noise. The anti-noise signal is provided to a noise cancellation driver, which transduces the signal into a soundwave that is presented to the user. When the anti-noise sound wave produced by the noise cancellation driver combines in the acoustic cavity with the noise sound wave, the two sound waves cancel one another due to destructive interference. The result is a reduction in the noise level perceived by the user in the area where noise reduction is desired.

Feedback systems generally have the potential of being unstable and producing instability based distortion. In feedback systems, the input to a system being controlled (called the "plant") is provided by forming a feedback loop that compares the output of the plant to a desired input or reference signal. One or more compensators within the feedback loop provide gain over a particular frequency spectrum to drive the difference between the output and the desired input (or reference signal) near zero over that frequency spectrum. Instability may result if the gain of a feedback loop at certain frequencies is greater than 1.

Additionally, movement of an earpiece can cause pressure within the earpiece to build to a high level. This pressure build up is referred to as an over-pressure disturbance. One or more holes or passageways in the earpiece are used to equalize pressure within the earpiece. However, the hole in an earpiece creates a leak between a chamber in the earpiece and an ambient environment. The leak allows environmental noise into the earpiece, thereby undermining attempts to reduce the noise.

III. SUMMARY

Earpiece overload caused by over-pressure disturbances is reduced or eliminated by transiently opening one or more passageways in the earpiece in response to the over-pressure disturbances. When compared to systems that employ constantly open passageways, systems described herein allow for superior passive attenuation and active noise reduction. For example, one or more open passageways in an earcup housing creates a leak that allows environmental noise to enter the earpiece, deleteriously impacting noise reduction efforts. Transiently opening the one or more passageways (and then closing the one or more passageways) reduces a duration of the leak, thereby reducing the deleterious impact of the leak on attempts to reduce noise within the earpiece.

In one implementation, an apparatus includes an earpiece that includes a chamber and one or more passageways. The apparatus includes a valve associated with the one or more passageways to selectively enable passage of a fluid through the one or more passageways. The apparatus includes a valve control assembly configured to control the valve based on acoustic pressure within the chamber.

In another implementation, a method includes sensing acoustic pressure within a chamber of an earpiece that includes one or more passageways. The method includes regulating acoustic pressure within the chamber by controlling passage of a fluid through the one or more passageways based on the sensed acoustic pressure. The method reduces or eliminates overload caused by overpressure disturbances (e.g., pressure build-up in the chamber) by allowing fluid to flow through the one or more passageways in response to detection of the overpressure disturbance.

IV. BRIEF DESCRIPTION OF THE DRAWINGS

V. DETAILED DESCRIPTION

There are a variety of different types of personal active noise reduction (ANR) devices, (e.g., devices that are structured to be at least partly worn by a user in the vicinity of at least one of the user's ears to provide ANR functionality for at least that one ear). For example, personal ANR devices include headphones, communications headsets (e.g., including boom microphones), earphones, earbuds, wireless headsets (also known as "earsets"), and ear protectors with various designs and features. Some devices provide for communication, including two-way audio communications or one-way audio communications (e.g., receive only). Some devices have wired or wireless connections between portions of the device or to other devices. As used herein, the term earpiece includes any type of small loudspeaker configured to be held in place at a location proximate to a user's ear, including, for example, circumaural headphones, supra-aural headphones, earbuds, in-ear headphones, and ear protectors. Though various components are described or illustrated within or outside of the earpiece, it will be understood that, unless otherwise stated, in other examples, one or more of the components are alternatively within or outside of the earpiece.

Figure 1:
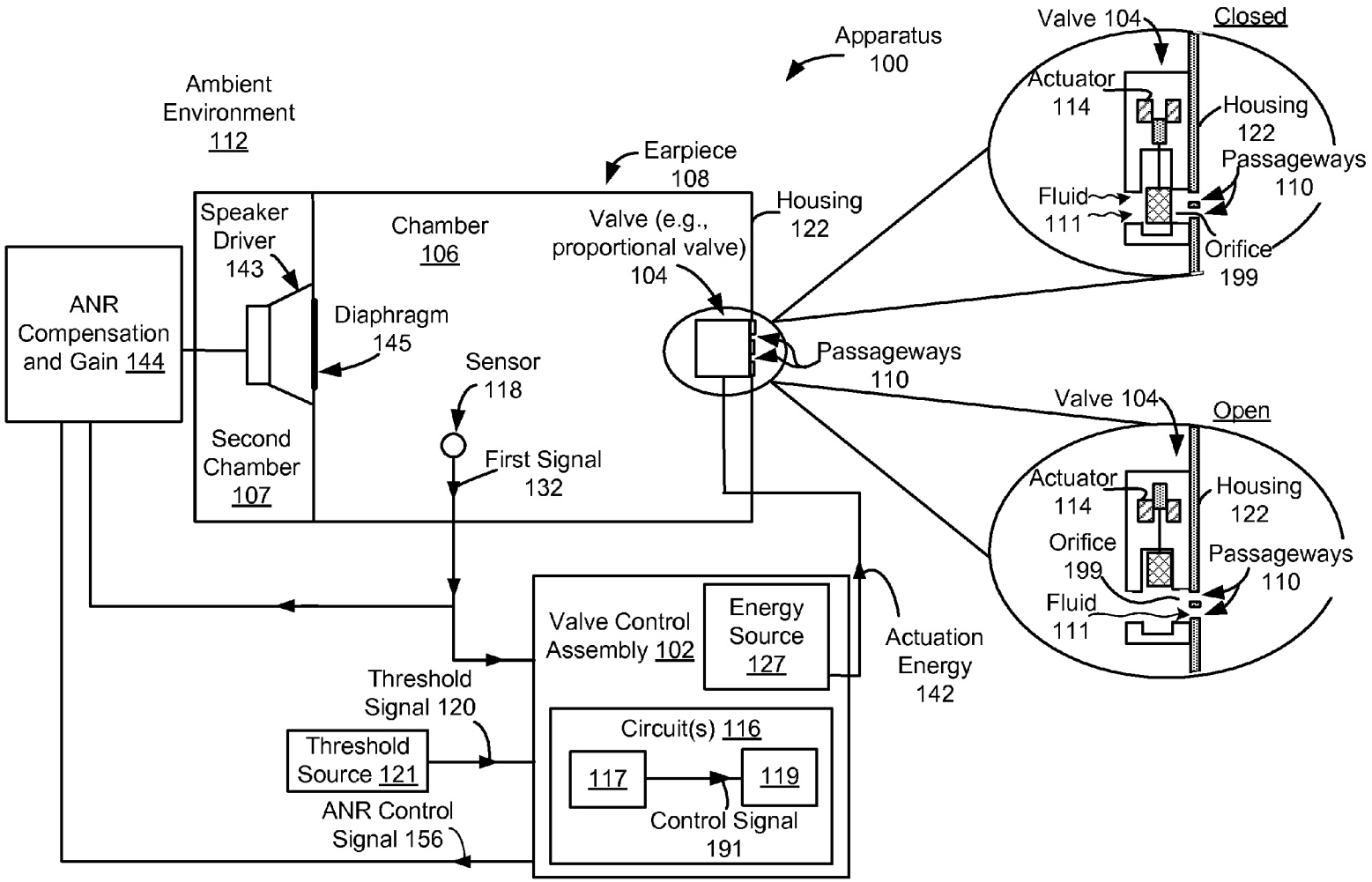
FIG. 1 is a diagram of an illustrative implementation of an active pressure equalization apparatus.

Referring to FIG. 1, an example of an apparatus (e.g., a headphone apparatus) is generally depicted as 100. The apparatus 100 includes an earpiece 108 that includes a chamber 106. As used herein, the term "chamber" refers to any enclosed or unenclosed volume, cavity, chamber, and/or void. An earpiece "includes" any chamber that is at least partially defined, formed, and/or integrated into, within, or by, one or more surfaces, barriers, divides, components, members, or layers of the earpiece 108. In one example, the chamber 106 is an inner chamber of a multi-chamber earcup. In another example, the chamber 106 is an outer chamber of a multi-chamber earcup. In another example, the chamber 106 includes at least a portion of an area, volume, or region at least partially bounded by an earcup or an earbud and a user's ear canal when the earcup or earbud is positioned on the user's head. In another example, the chamber 106 includes at least a portion of an area, volume, or region that is at least partially bounded by a diaphragm 145 of a speaker driver (e.g., a speaker) 143 and at least a portion of a user's ear when the earcup or earbud is positioned on the user's head.

The earpiece 108 includes a valve 104 configured to regulate acoustic pressure within the chamber 106 by selectively enabling a fluid (e.g., air) 111 to pass through a passageway 110 and out of the chamber 106. The one or more passageways 110 include one or more discontinuities, holes, orifices, passages, slits, ports, openings, or apertures. When unobstructed and/or open, the one or more passageways 110 enable the fluid 111 within the chamber 106 to flow through the one or more passageways 110 and out of the chamber 106. The valve 104 controls passage of the fluid 111 through the one or more passageways 110 by controlling one or more valve orifices 199. For example, when the valve 104 is in an open valve state, the valve 104 opens or unobstructs the one or more valve orifices 199, thereby unobstructing or opening the one or more passageways 110 and allowing the fluid 111 to flow through the one or more passageways 110. The valve 104 is any device that regulates, directs or controls the flow of a fluid (e.g., the fluid 111) by opening, closing, or partially obstructing one or more orifices or passageways. The valve 104 is illustrated as including a single valve orifice. Alternatively, the valve 104 includes multiple valve orifices 199.

In some examples, the one or more passageways 110 are proximate to, or at least partially defined by, formed of, coupled to, or integrated into a surface that separates the earpiece 108 from an ambient environment 112. For example, the one or more passageways 110 are proximate to, or at least partially defined by, formed of, coupled to, or integrated into a housing 122 of the earpiece 108. In these examples, when open or unobstructed, the one or more passageways 110 enable the fluid 111 within the chamber 106 to flow out of the chamber 106 into the ambient environment 112.

In other examples, the one or more passageways 110 are not proximate to or at least partially defined by, formed of, coupled to, or integrated into, at least a portion of a surface of the earpiece 108 that separates the chamber 106 from the ambient environment 112. For example, a second chamber 107 is located between the one or more passageways 110 and the ambient environment 112. The one or more passageways 110 are proximate to or at least partially defined by, formed of, coupled to, or integrated into an inner surface (e.g., an interior wall, partition, screen, or divide) of the earpiece 108 that separates the chamber 106 from the second chamber 107. Examples of this passageway placement are described in more detail with reference to FIG. 5.

The valve 104 includes, or is coupled to, an actuator 114. In some examples, the actuator 114 is an electrically energizable actuator, such as a solenoid, a piezoelectric member, a shape memory alloy wire, or a combination thereof. In these examples, the valve 104 is actuated (e.g., stroked, opened, closed) by electrically energizing or de-energizing the actuator 114. Solenoid valves are described in more detail below with reference to FIGS. 2A and 2B. Shape memory alloy wire valves are described in more detail with reference to FIGS. 3A and 3B.

In some examples, the valve 104 is a two-position valve having an at-rest state (e.g., a closed valve state) and an actuated state (e.g., an open valve state). When in the closed valve state, the valve 104 is configured to at least partially obstruct, close, or seal the one or more passageways 110, thereby preventing or limiting flow of the fluid 111 through the one or more passageways 110. For example, when in the closed valve state, the valve 104 at least partially obstructs or close the one or more passageways 110 by at least partially obstructing, closing, or sealing the one or more valve orifices 199.

When in the open valve state, the valve 104 is configured to open, unseal, or to otherwise not obstruct, or to reduce (relative to the closed valve state) obstruction of, passage of the fluid 111 through the one or more passageways 110. For example, when in the open valve state, the valve 104 opens, unseals, or otherwise does not obstruct the one or more passageways 110 by at least partially opening, unsealing, or unobstructing the one or more valve orifices 199. As examples, the upper exploded view in FIG. 1 depicts the valve 104 in the closed valve state, and the lower exploded view depicts the valve 104 in the open valve state. In some examples, the valve 104 has more than two states. In some examples, the valve 104 is a metering valve or a proportional valve. In some examples, the actuator 114 is a servo motor.

In some examples, the apparatus 100 includes a sensor 118 to sense acoustic pressure within the chamber 106. In some examples, the sensor 118 is an electroacoustical transducer, such as a feedback microphone. In some examples, the sensor 118 is located within the chamber 106. In some examples, the sensor 118 is configured to operate as a signal source in a closed-loop active or adaptive noise reduction system. The sensor 118 outputs a signal (e.g., a "first signal") 132 that corresponds to acoustic pressure (e.g., an amount of acoustic pressure) in the chamber 106. In some examples, acoustic pressure within the chamber 106 corresponds to sound emitted by a speaker driver 143 and/or noise (e.g., structural noise, operator noise, or external noise). In some examples, the first signal 132 provides feedback data used by a compensation and gain unit 144. In some examples, the compensation and gain unit 144 is configured to compensate for noise within the earpiece 108 by adjusting a signal provided to a speaker driver 143 using one or more active noise reduction or cancellation techniques. The compensation and gain unit 144 includes audio processing components, such as an amplifier driver, an equalizer, or a feedback compensation module.

The apparatus 100 includes a valve control assembly 102 configured to control (e.g., initiate opening or closing of) the valve 104 based on acoustic pressure within the chamber 106. In some examples, the valve control assembly 102 is configured to initiate opening of the valve 104 by energizing the actuator 114. In some examples, the valve control assembly 102 is configured to energize the actuator 114 by applying or initiating application of actuation energy 142. The valve control assembly 102 is configured to initiate closing of the valve 104 by not energizing (e.g., de-energizing) the actuator 114. For example, to de-energize the actuator 114, the valve control assembly 102 does not apply, or initiates cutting off application of, the actuation energy 142 to the actuator 114.

In some examples, the valve control assembly 102 is configured to control the valve 104 based on whether acoustic pressure within the chamber 106 satisfies a threshold. The valve control assembly 102 is configured to initiate opening of the valve 104 when acoustic pressure in the chamber 106 satisfies the threshold. Alternatively or additionally, the valve control assembly 102 is configured to initiate closing of the valve 104 when acoustic pressure in the chamber 106 does not satisfy the threshold. The threshold corresponds to a pressure such that an amount of acoustic pressure within the chamber 106 in excess of the threshold is indicative of an over-pressure disturbance. For example, a user pushes on or otherwise moves the earpiece 108 during use (e.g., while removing or adjusting the earpiece 108). Movement of the earpiece 108 produces an acoustic pressure spike within the chamber 106 that is referred to as an over-pressure disturbance.

In some examples, the valve control assembly 102 includes, or is coupled to, a threshold source 121. The threshold source 121 is configured to provide or apply a signal 120 corresponding to the threshold (e.g., a "threshold signal"). In some examples, the threshold signal 120 is a voltage signal. The valve control assembly 102 is configured to use the first signal 132 to determine whether the acoustic pressure within the chamber 106 satisfies the threshold. For example, the valve control assembly 102 is configured to determine that acoustic pressure within the chamber 106 satisfies the threshold when a value of the first signal 132 (or a signal at least partially derived therefrom or in response thereto) exceeds the value of the threshold signal 120. Alternatively or additionally, the valve control assembly 102 is configured to determine that acoustic pressure in the chamber 106 does not satisfy the threshold when the value of the first signal 132 (or a signal at least partially derived therefrom or in response thereto) does not exceed the value of the threshold signal 120.

In some examples, the valve control assembly 102 includes one or more circuits 116 that are configured to receive, process, and analyze the first signal 132 (or a signal at least partially derived therefrom or in response thereto) to determine whether acoustic pressure within the chamber 106 satisfies the threshold. In these examples, the one or more circuits 116 include one or more circuits 117 configured to process the first signal 132 and to compare the processed first signal to the threshold signal 120 to determine whether acoustic pressure within the chamber 106 satisfies the threshold.

The one or more circuits 117 are configured to assert or output a control signal 191 indicative of whether acoustic pressure within the chamber 106 satisfies the threshold. In some examples, the one or more circuits 117 are configured to output a first control signal 191 corresponding to the open valve state when the value of the first signal 132 (or a signal at least partially derived therefrom or in response thereto) exceeds the value of the threshold signal 120. Additionally or alternatively, the one or more circuits 117 are configured to output a second control signal 191 corresponding to the closed valve state when the value of the first signal 132 (or the signal at least partially derived therefrom or in response thereto) does not exceed the threshold signal 120.

In some examples, an ANR control signal 156 is provided to the ANR compensation and gain unit 144 when the value of the first signal 132 (or the signal at least partially derived therefrom or in response thereto) exceeds the threshold. Thus, the ANR compensation and gain unit 144 may receive the ANR control signal 156 responsive to an over-pressure disturbance or state as described above. In some examples, the one or more circuits 116 are configured to generate and/or output the ANR control signal 156 responsive to the over-pressure disturbance or state (e.g., when the one or more circuits 116 output the first control signal 191). In some examples, the ANR compensation and gain unit 144 is configured to adjust feedback parameters, feedforward parameters, audio equalization compensation parameters, or a combination thereof, in response to the ANR control signal 156. For example, the ANR compensation and gain unit 144 may adjust a loop gain of a feedback loop in response to the ANR control signal 156. In some of these examples, the ANR compensation and gain unit 144 may adjust the loop gain of the feedback loop in response to the ANR control signal 156 as described in U.S. Patent Application Publication 2013/0329902 titled "PRESSURE-RELATED FEEDBACK INSTABILITY MITIGATION," which is hereby incorporated in its entirety.

In some examples, the one or more circuits 116 are configured to energize or initiate energizing the actuator 114 based on the control signal 191. For example, the one or more circuits 119 include one or more switches or other electrical components configured to electrically couple the valve 104 (e.g., the actuator 114) to an energy source 127 when the first control signal 191 is asserted. When the valve 104 (e.g., the actuator 114) is electrically coupled to the energy source 127, actuation energy 142 from the energy source 127 is applied to the valve 104 (e.g., the actuator 114). When applied to the valve 104, the actuation energy 142 energizes the actuator 114, causing the valve 104 to open (or to remain in the open valve state), thereby allowing the fluid 111 to flow through the one or more passageways 110. Alternatively or additionally, the one or more circuits 119 includes one or more switches or other electrical components configured to electrically decouple the valve 104 from the energy source 127 when the second control signal 191 is asserted, thereby not applying the actuation energy 142 to the valve 104. When the actuation energy 142 is not applied to the valve 104, the actuator 114 is de-energized, causing the valve 104 to close (or remain in the closed valve state), thereby at least partially obstructing the one or more passageways 110 and preventing (or reducing an amount of) flow of the fluid 111 through the one or more passageways 110.

Thus, pressure built up in the chamber 106 in response to an over-pressure disturbance is detected based on information from the sensor 118 and is relieved by transiently opening or unobstructing (e.g., opening for a short time period) the one or more passageways 110. Closing the one or more passageways 110 when not being used to equalize pressure as described above reduces environmental noise within the earpiece 108 as compared to constantly open ports or passageways. Reducing environmental noise within the earpiece 108 supports attempts to passively or actively reduce noise within the earpiece 108.

Though the valve control assembly 102 is described in detail above with reference to a two-state valve, it will be understood that, in some examples, the valve 104 includes more than two-states. In some of these examples, the valve 104 is a control valve, a metering valve, or a proportional valve. For example, when the valve is a control valve, the valve control assembly 102 of FIG. 1 includes a valve positioner [not illustrated] configured to receive a signal corresponding to sensed acoustic pressure in the chamber 106 and to output a control signal corresponding to a valve position. The valve positioner includes a microprocessor configured to convert or relate a signal corresponding to the sensed acoustic pressure in the chamber 106 (e.g., the first signal 132 or a signal at least partially derived therefrom or in response thereto) to a valve position (a "determined valve position") based on a particular (e.g., a linear or non-linear) relationship between sensed acoustic pressure and valve position. The valve positioner is configured to output a control signal corresponding to the valve position to move the valve 104 to the determined valve position. The valve 104 is thus configured to be opened or closed an amount proportional to the sensed acoustic pressure (or a sensed acoustic pressure above a threshold) in the chamber 106.

Figure 2A:
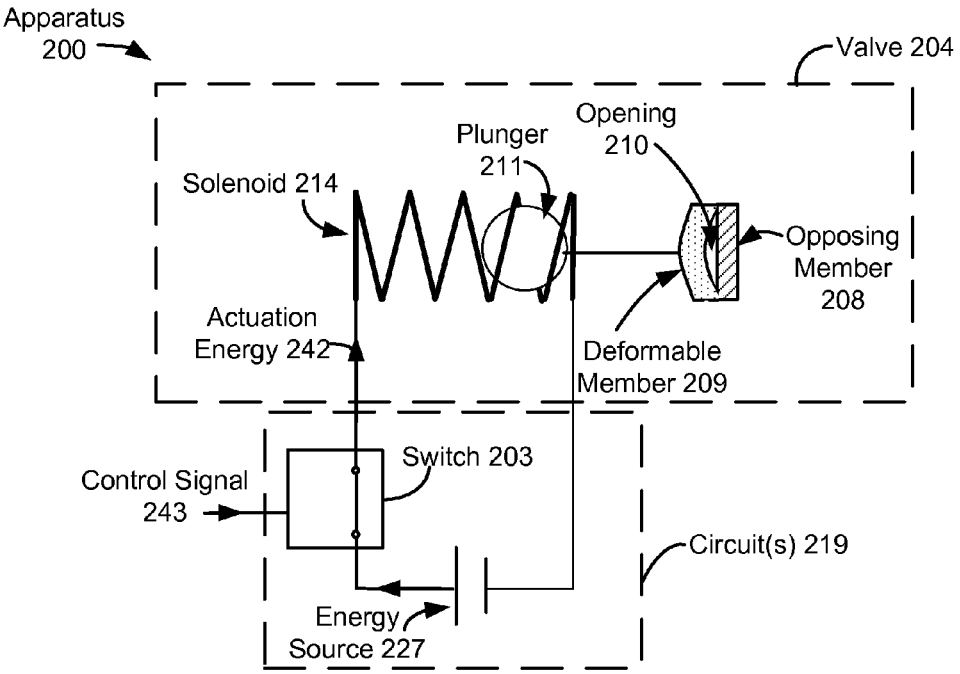
FIGS. 2A-2B are diagrams of an illustrative implementation of an active pressure equalization apparatus that includes a solenoid valve.
Figure 2B:
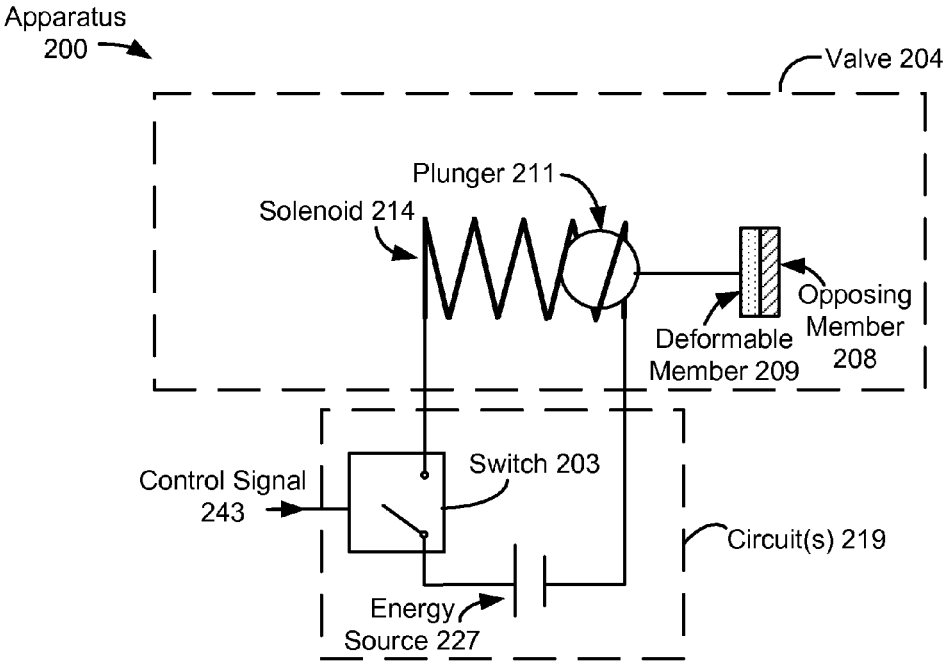

With reference to FIGS. 2A-2B, an apparatus that includes a solenoid valve 204 is generally depicted as 200. The apparatus 200 corresponds to the valve 104 and the one or more circuits 119 of the apparatus 100 of FIG. 1. FIG. 2A depicts the solenoid valve 204 in the open valve state, while FIG. 2B depicts the solenoid valve 204 in the closed valve state. The solenoid valve 204 corresponds to the valve 104 of FIG. 1. The solenoid 214 corresponds to the actuator 114 of FIG. 1. The one or more circuits 219 correspond to the one or more circuits 119 of FIG. 1. The opening 210 corresponds to a valve orifice and/or a passageway in an earpiece. For example, the opening 210 corresponds to the valve orifice 199 of FIG. 1 and/or the one or more passageways 110 of FIG. 1.

In some examples, the solenoid valve 204 includes a deformable member 209 that is formed of a deformable material. In some examples, the deformable member 209 is formed of, or includes, rubber or silicone. In some examples, the solenoid valve 204 also includes an opposing member 208. The opposing member 208 is fixed or deformable. In some examples in which the opposing member 208 is deformable, the opposing member 208 is formed of or includes rubber or silicone. When the opposing member 208 is not deformable, the opposing member 208 is a fixed wall or other surface formed of a rigid material. The opposing member 208 and the deformable member 209 are formed proximate to, or at least partially defined by, formed of, coupled to, or integrated into a surface of an earpiece. For example, the opposing member 208 and the deformable member 209 are formed proximate to, or at least partially defined by, formed of, coupled to, or integrated into a housing 122 of the earpiece 108 of FIG. 1. Moving at least a portion of the deformable member 209 away from the fixed opposing member 208 opens, forms, or unobstructs, the opening 210 between the deformable member 209 and the opposing member 208. Opening, forming, or unobstructing the opening 210 allows fluid to flow through a passageway.

The one or more circuits 219 include or are coupled to a control signal source to receive a control signal 243. In this example, the control signal 243 corresponds to the control signal 191 of FIG. 1. For example, the control signal 243 corresponds to the open valve state described above when the sensed acoustic pressure in the chamber 106 of FIG. 1 satisfies the threshold corresponding to the threshold signal 120 of FIG. 1. Alternatively or additionally, the control signal 243 corresponds to the closed valve state described above when the sensed acoustic pressure in the chamber 106 of FIG. 1 does not satisfy the threshold corresponding to the threshold signal 120 of FIG. 1. The one or more circuits 219 include one or more switches 203 that are configured to toggle based on the control signal 243. The one or more switches 203 are configured to cooperate to couple one or more energy sources 227 to the solenoid valve 204 based on the control signal 243. In some examples, the one or more switches 203 are configured to close in response to application of the control signal 243 corresponding to the open valve state. When the one or more switches 203 are closed, the energy source 227 is electrically coupled to the solenoid 214. When electrically coupled to the solenoid 214, the energy source 227 energizes the solenoid 214, thereby actuating the solenoid valve 204. Alternatively or additionally, the one or more switches 203 are configured to open in response to application of the control signal 243 corresponding to the closed valve state. When the one or more switches 203 are open, the energy source 227 is electrically de-coupled from the solenoid 214. When electrically de-coupled from the solenoid 214, the solenoid 214 is de-energized, closing the solenoid valve 204 and thereby closing, sealing, or otherwise obstructing the opening 210.

In some examples, the solenoid 214 is a push or pull solenoid configured to push or pull a plunger (e.g., a metal plunger) 211 based on whether the solenoid 214 is energized. With reference to FIG. 2A, when a valve control assembly determines that acoustic pressure within a chamber satisfies the threshold as described above, one or more circuits asserts the control signal 243 that corresponds to the open valve state and causes the switch 203 to close, electrically coupling the one or more energy sources 227 to the solenoid 214. For example, when the valve control assembly 102 of FIG. 1 determines that acoustic pressure in the chamber 106 satisfies the threshold as described above, the one or more circuits 117 asserts the control signal 243 of FIG. 2 that corresponds to the open valve state and causes the one or more switches 203 to close, electrically coupling the one or more energy sources 227 to the solenoid 214. When the solenoid 214 is electrically coupled to the one or more energy sources 227, the solenoid 214 generates an electromagnetic field. The electromagnetic field generated by the solenoid 214 in response to energy (e.g., the actuation energy 142 of FIG. 1) from the energy source 227 pulls (or pushes) the plunger 211 away from the fixed opposing member 208, causing at least a portion of the deformable member 209 and the opposing member 208 to separate, thereby opening, forming, or unobstructing the opening 210. Thus, the apparatus 200 of FIG. 2 opens the solenoid valve 204 when the sensed acoustic pressure in the chamber 106 of FIG. 1 satisfies the threshold.

Alternatively or additionally, with reference to FIG. 2B, when a valve control assembly determines that acoustic pressure within a chamber satisfies the threshold, one or more circuits assert a control signal that corresponds to the closed valve state and causes the one or more switches 203 to open, electrically de-coupling the one or more energy sources 227 from the solenoid 214. For example, when the valve control assembly 102 of FIG. 1 determines that acoustic pressure in the chamber 106 does not satisfy the threshold, the one or more circuits 117 of FIG. 1 asserts the control signal 243 that corresponds to the open valve state and causes the one or more switches 203 to close, thereby electrically de-coupling the one or more energy sources 227 from the solenoid 214. When electrically decoupled from the one or more energy sources 227, the solenoid 214 does not push or pull on the solenoid 214, thereby obstructing or closing the opening 210. Thus, the apparatus 200 of FIG. 2 closes the solenoid valve 204 when the sensed acoustic pressure in the chamber 106 of FIG. 1 does not satisfy the threshold.

Figure 3A:
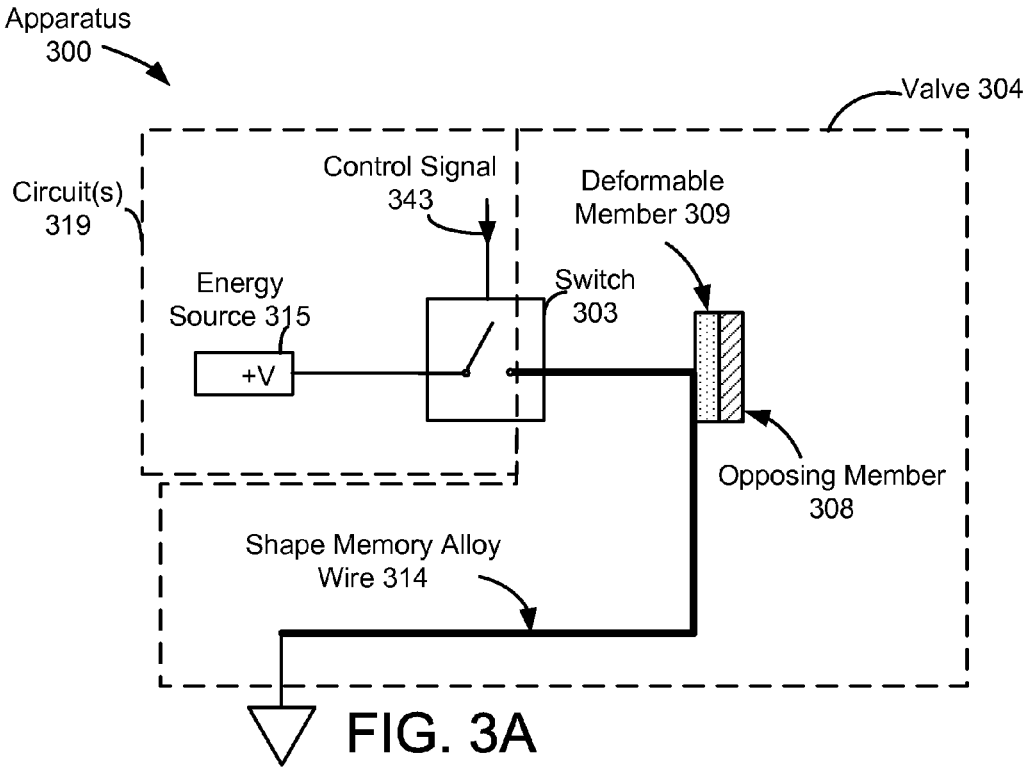
FIGS. 3A-3B are diagrams of an illustrative implementation of an active pressure equalization apparatus that includes a shape memory alloy wire.
Figure 3B:
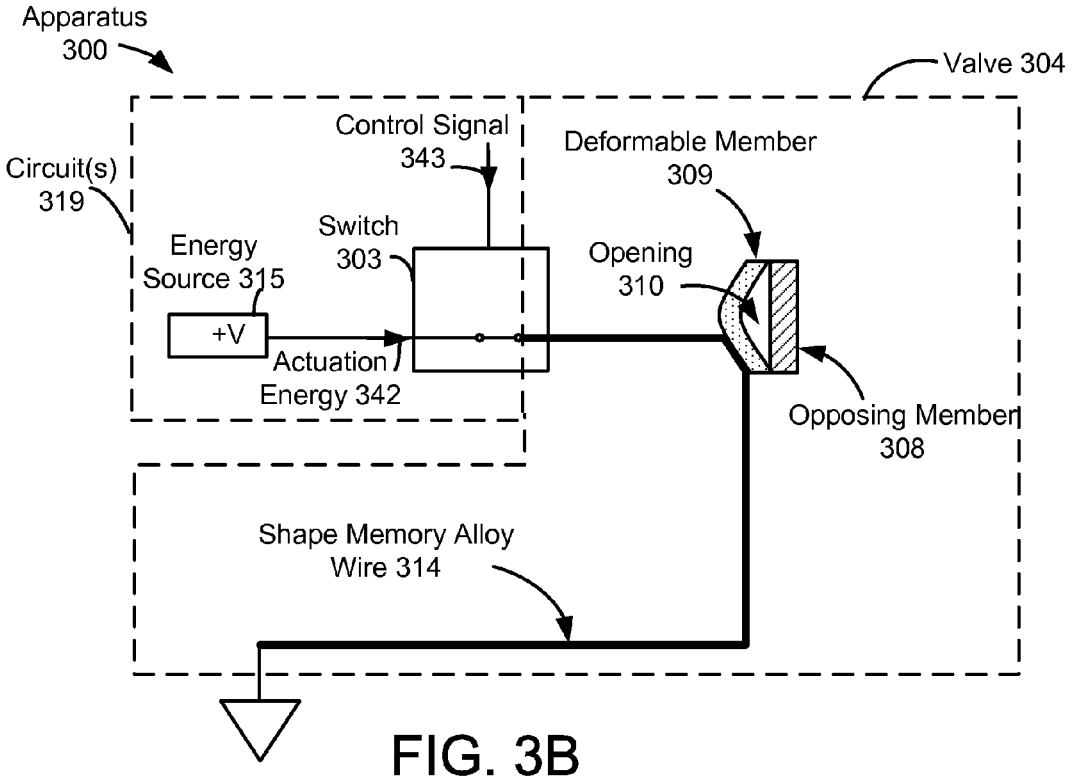

With reference to FIGS. 3A-3B, an apparatus that includes a shape memory alloy valve 304 is generally depicted as 300. The apparatus 300 corresponds to the valve 104 and the one or more circuits 119 of the apparatus 100 of FIG. 1. FIG. 3A depicts the shape memory alloy valve 304 as being closed, while FIG. 3B depicts the shape memory alloy valve 304 as being open. The shape memory alloy valve 304 corresponds to the valve 104 of FIG. 1. The one or more circuits 319 corresponds to the one or more circuits 119 of FIG. 1. The shape memory alloy valve 304 includes an opposing member 308 and a deformable member 309. The opposing member 308 and the deformable member 309 are formed as described above with reference to the opposing member 208 and the deformable member 209 of FIG. 2.

The shape memory alloy valve 304 includes a shape memory alloy wire 314 that is responsive to application of energy from one or more energy sources 315. For example, the shape memory alloy wire 314 is configured to deform (e.g., contract, bend, or otherwise move) in response to application of energy from the one or more energy sources 315. When deformed, the shape memory alloy wire 314 causes the deformable member 309 to separate or move away from the fixed member 308, thereby opening, forming, or unobstrucing the opening 310. Opening, forming, or unobstructing the opening 310 allows fluid (e.g., the fluid 111 of FIG. 1) to flow through the passageway.

The one or more circuits 319 are coupled to a control signal source to receive a control signal 343. The control signal 343 corresponds to the control signal 191 of FIG. 1 or the control signal 243 of FIG. 2. For example, the control signal 343 corresponds to the open valve state described above when the sensed acoustic pressure in the chamber 106 of FIG. 1 satisfies the threshold corresponding to the threshold signal 120 of FIG. 1. Alternatively or additionally, the control signal 343 corresponds to the closed valve state described above when the sensed acoustic pressure in the chamber 106 of FIG. 1 does not satisfy the threshold corresponding to the threshold signal 120 of FIG. 1.

The one or more circuits 319 include one or more switches 303 configured to toggle based on the control signal 343. For example, the one or more switches 303 are configured to close in response to application of the control signal 343 corresponding to the open valve state. When the one or more switches 303 are closed, the one or more energy sources 315 are electrically coupled to the shape memory alloy wire 314. When electrically coupled to the shape memory alloy wire 314, the one or more energy sources 315 energize the shape memory alloy wire 314, thereby actuating the shape memory alloy valve 304. Alternatively or additionally, the one or more switches 303 are configured to open in response to application of the control signal 343 corresponding to the closed valve state. When the one or more switches 303 are open, the one or more energy sources 315 are electrically de-coupled from the shape memory alloy wire 314. When electrically de-coupled from the shape memory alloy wire 314, the shape memory alloy wire 314 is de-energized, closing the shape memory alloy valve 304 and thereby closing, sealing, or otherwise obstructing the opening 310.

For example, with reference to FIG. 3A, application of the control signal 343 corresponding to the closed valve state causes the switch 303 to open (or to remain open), electrically decoupling the shape memory alloy wire 314 from the one or more energy sources 315. When the shape memory alloy wire 314 is electrically decoupled from the one or more energy sources 315, energy from the one or more energy sources 315 is not applied to the shape memory alloy wire 314 (e.g., when the switch 303 is open), thereby not causing the shape memory alloy wire 314 to deform (e.g., the shape memory alloy wire 314 does not contract or bend). Thus, when the switch 303 is open, the shape memory alloy wire 314 does not act on the deformable member 309, resulting in the shape memory alloy valve 304 being in an at-rest position. Thus, the apparatus 300 of FIG. 3 closes the shape memory alloy valve 304 when the sensed acoustic pressure in the chamber 106 of FIG. 1 does not satisfy the threshold.

Alternatively or additionally, with reference to FIG. 3B, application of the control signal 343 corresponding to the open valve state causes the switch 303 to close (or to remain closed), electrically coupling the shape memory alloy wire 314 to the one or more energy sources 315. When the shape memory alloy wire 314 is electrically coupled to the one or more energy sources 315, energy applied to the shape memory alloy wire 314 causes the shape memory alloy wire 314 to deform. For example, application of the actuation energy 142 of FIG. 1 causes the shape memory alloy wire 314 to deform. Thus, the apparatus 300 of FIG. 3 opens the shape memory alloy valve 304 when the sensed acoustic pressure in the chamber 106 of FIG. 1 satisfies the threshold.

Figure 4:
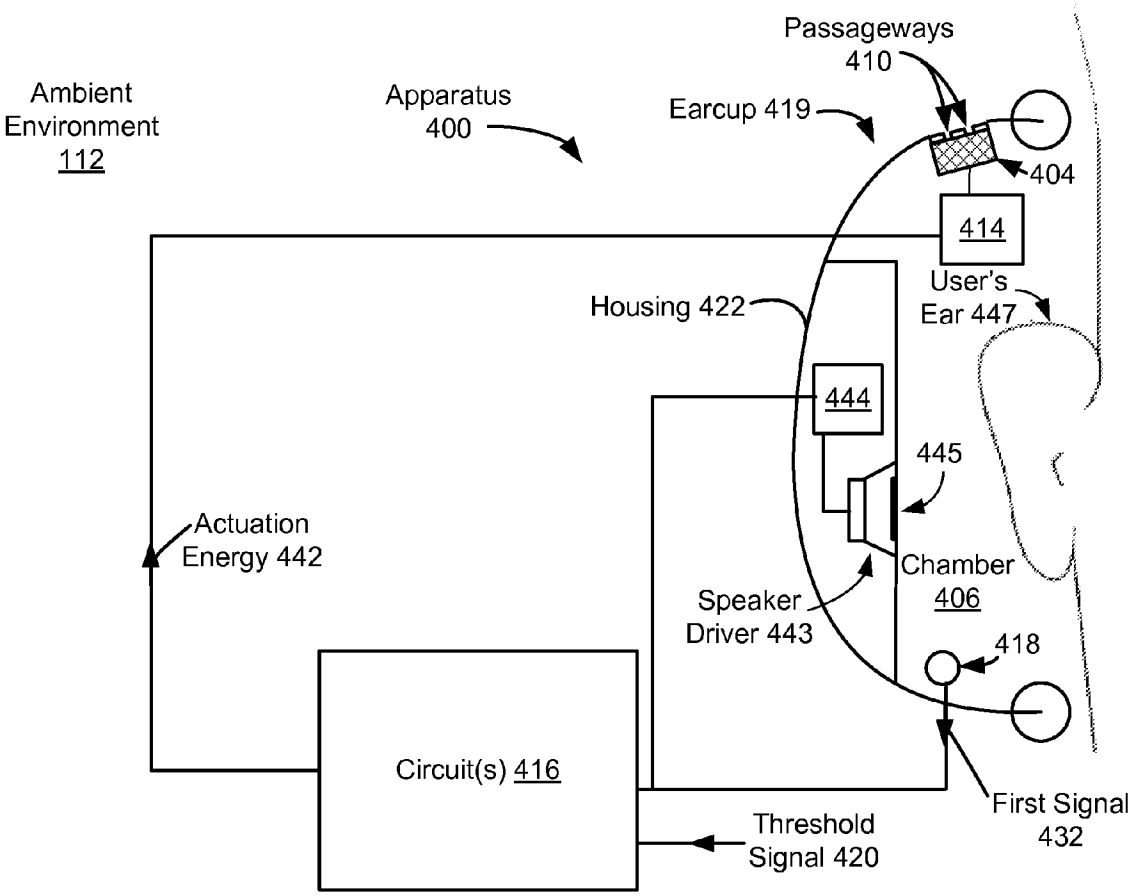
FIG. 4 is a diagram of an illustrative implementation of an active pressure equalization apparatus that includes an earcup.

With reference to FIG. 4, an apparatus (e.g., a headphone apparatus) that includes one or more passageways 410 formed in a housing 422 of an earcup 419 is generally depicted as 400. The apparatus 400 may be included in headphones configured to be worn by a user such that, when worn, the earcup 419 is proximate to an ear 447 of the user. In some examples, the earcup 419 is configured to form a seal around the user's ear 447. In some examples, the apparatus 400 corresponds to the apparatus 100 of FIG. 1. In some examples, the apparatus 400 includes a speaker driver 443 that includes a diaphragm 445 and an ANR compensation and gain unit 444. In some examples, the speaker driver 443 and the ANR compensation and gain unit 444 operate as described above with reference to the speaker driver 143 and the ANR compensation and gain unit 144 of FIG. 1. In some examples, the earcup 419 corresponds to the earpiece 108 of FIG. 1 and the first signal 432 corresponds to the first signal 132. A sensor 418 corresponds to the sensor 118 of FIG. 1. The valve 404 corresponds to any of the valves 104, 204, or 304 of FIGS. 1, 2A and 2B, or 3A and 3B, respectively. The one or more passageways 410 correspond to the one or more passageways 110 of FIG. 1. The valve 404 formed in the housing 422 of the earcup 419 selectively enables passage of fluid (e.g., air) from the chamber 406 through the one or more passageways 410 into the ambient environment 112, as described above. The threshold signal 420 corresponds to the threshold signal 120 of FIG. 1.

The apparatus 400 includes one or more circuits 416 that correspond to the one or more circuits 116 of FIG. 1. The one or more circuits 416 are configured to determine whether acoustic pressure within the chamber 406 satisfies the threshold, as described above and as described below with reference to FIG. 6. When the acoustic pressure in the chamber 406 satisfies the threshold, the one or more circuits 416 are configured to apply (or initiate application of) actuation energy 442 to the valve 404, thereby energizing the actuator 414. Energizing the actuator 414 causes the valve 404 to open, form, or unobstruct a valve orifice or an opening. For example, energizing the actuator 414 causes the valve 404 to open, form or unobstruct the valve orifice 199 of FIG. 1, the opening 210, or the opening 310. Opening, forming, or unobstructing the valve orifice (e.g., the valve orifice 199 of FIG. 1) or the opening (e.g., the opening 210 or 310 of FIGS. 2A and 2B or 3A and 3B, respectively) opens or unobstructs the one or more passageways 410. In some examples, opening, forming, or unobstructing the one or more passageways 410 relieves pressure within the chamber 406 by allowing fluid, such as the fluid 111 of FIG. 1, to flow from the chamber 406, through the one or more passageways 410, and into the ambient environment 112. When the acoustic pressure in the chamber 406 does not satisfy the threshold (e.g., acoustic pressure is relieved and the pressure detected by the sensor 418 has decreased to a pressure below the threshold), the one or more circuits 416 are configured to discontinue applying the actuation energy 442 to the actuator 414, thereby causing the valve 404 to close, thereby closing or obstructing the one or more passageways 410 and preventing or reducing flow of fluid through the one or more passageways 410. Thus, the valve 407 controls flow of the fluid 111 of FIG. 1 through one or more passageways 410 in a housing 422 of an earcup 419 based on sensed acoustic pressure in the earcup 419.

Figure 5:
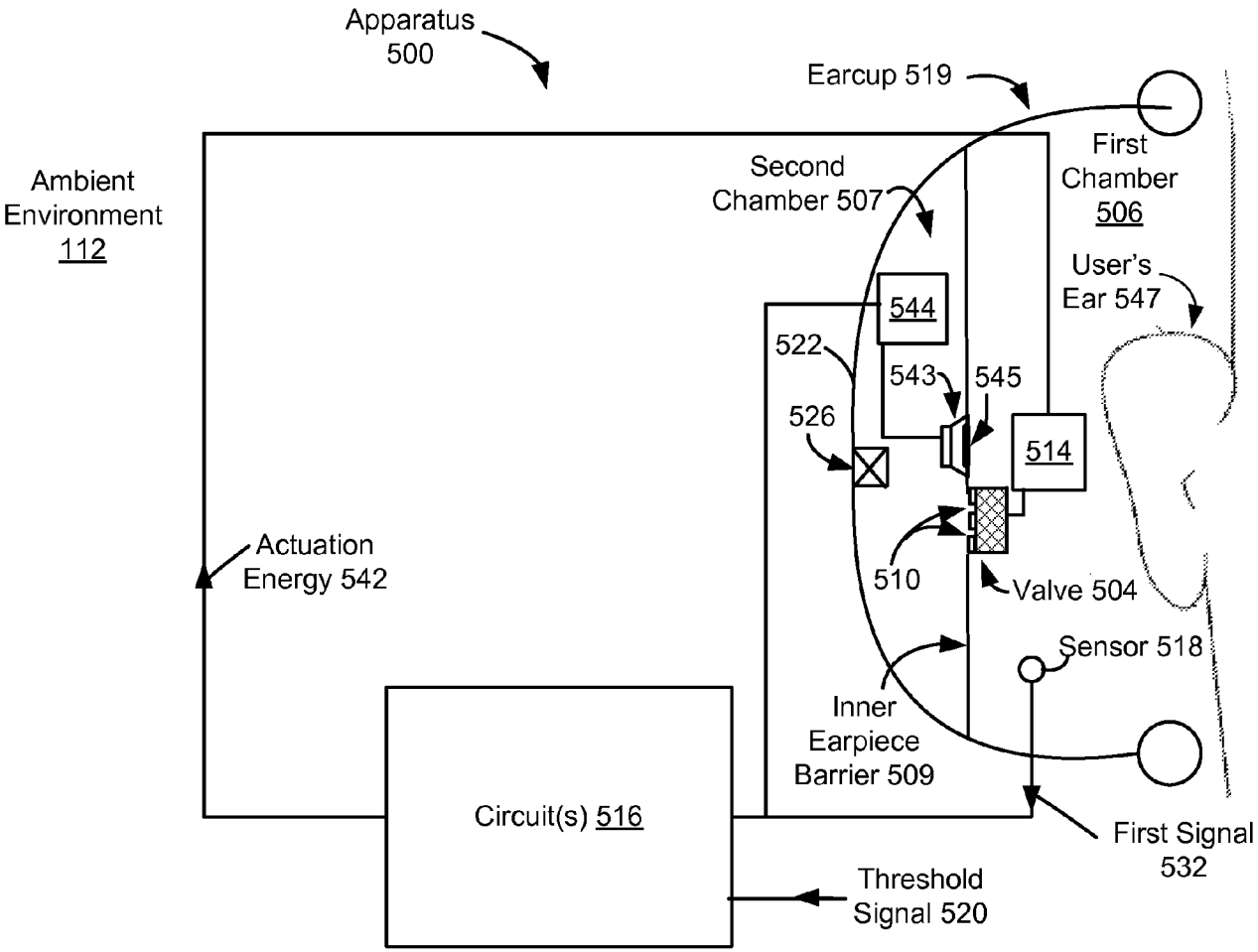
FIG. 5 is a diagram of an illustrative implementation of an active pressure equalization apparatus that includes multiple chambers and a passive equalization port.

With reference to FIG. 5, an apparatus (e.g., a headphone apparatus) configured to release acoustic pressure in a first chamber 506 through one or more passageways 510 into a second chamber 507 is generally depicted as 500. The apparatus 500 may be included in headphones configured to be worn by a user such that, when worn, the earcup 519 is proximate to an ear 547 of the user. In some examples, the earcup 519 is configured to form a seal around the user's ear 547. In some examples, the apparatus 500 corresponds to the apparatus 100 of FIG. 1. In some examples, the apparatus 500 includes a speaker driver 543 that includes a diaphragm 545 and an ANR compensation and gain unit 544. In some examples, the speaker driver 543 and the ANR compensation and gain unit 544 operate as described above with reference to the speaker driver 143 and the ANR compensation and gain unit 144 of FIG. 1. The apparatus 500 includes an earcup 508 that corresponds to the earpiece 108 of FIG. 1. A sensor 518 corresponds to the sensor 118 of FIG. 1. The first chamber 506 corresponds to the chamber 106 of FIG. 1. The earcup 519 includes a barrier 509 (e.g., an "inner earpiece barrier") within the earcup 508 that separates the first chamber 506 from the second chamber 507. The one or more passageways 510 is at least partially defined by, formed of, or integrated into, the barrier 509. The valve 504 corresponds to the valve 104, 204, or 304 of FIGS. 1-3, respectively, and is configured to open and close based on acoustic pressure in the first chamber 506 as described above with reference to FIGS. 1-4. The threshold signal 520 corresponds to the threshold signal 120 of FIG. 1, the first signal 532 corresponds to the first signal 132 of FIG. 1, and the actuation energy 542 corresponds to the actuation energy 142 of FIG. 1.

When the valve 504 is open, fluid, such as the fluid 111 of FIG. 1, in the first chamber 506 flows through the one or more passageways 510 into the second chamber 507. The fluid that flows through the one or more passageways 510 into the second chamber 507 is released into ambient environment 512. In some examples, the flow of fluid out of the second chamber 507 into the ambient environment 512 is controlled using a port 526 (e.g., a passive equalization port) formed in or proximate to, an exterior surface (e.g., the housing 522) of the earcup 508. Thus, the valve 504 controls flow of the fluid 111 of FIG. 1 through one or more passageways 510 in an internal surface of the earcup 519 based on sensed acoustic pressure in the earcup 519.

Figure 6:
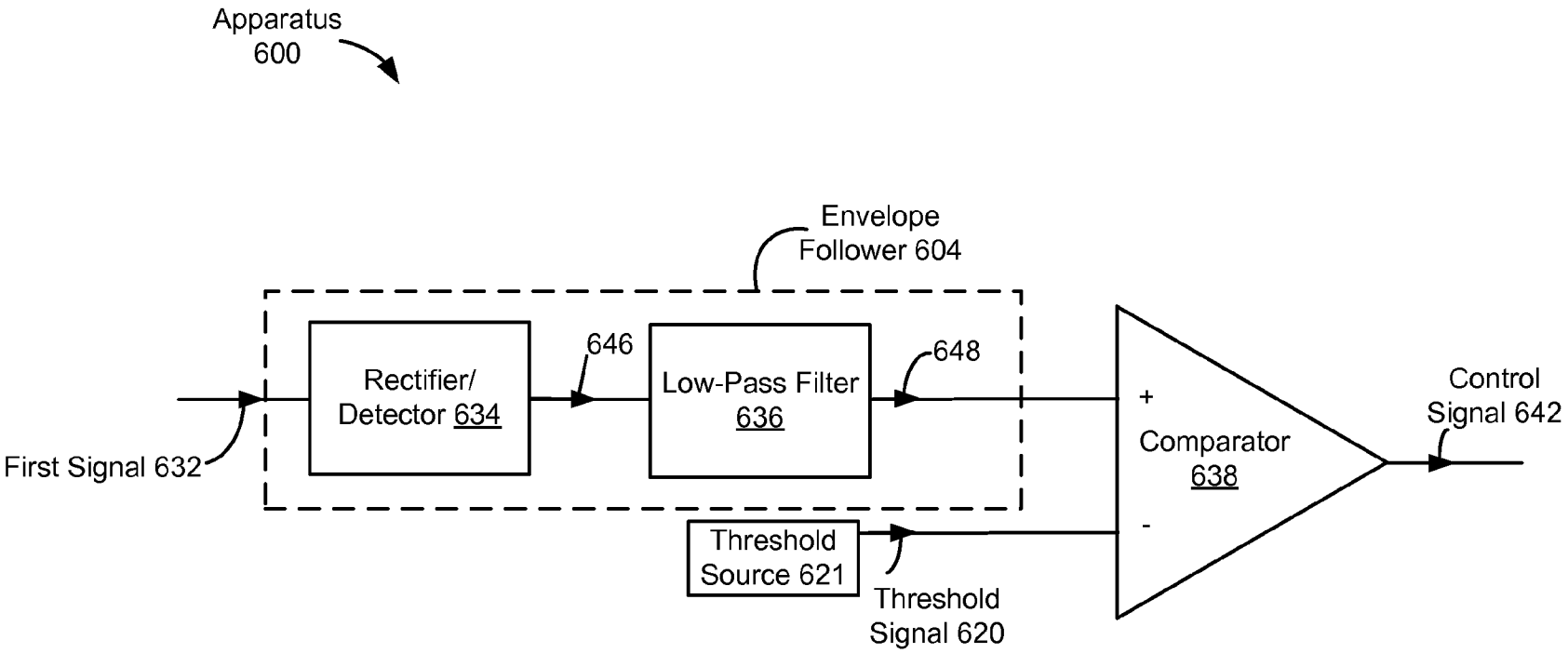
FIG. 6 is a diagram of an illustrative implementation of one or more circuits of an illustrative valve control assembly.

Referring to FIG. 6, an example of one or more circuits configured to determine whether acoustic pressure within a chamber of an earpiece satisfies a threshold is generally depicted as 600. In some examples, the one or more circuits 600 correspond to the one or more circuits 117 of FIG. 1. The one or more circuits 600 are configured to receive a first signal 632 (or a signal at least partially derived therefrom or in response thereto) from a sensor within a chamber of an earpiece. The chamber corresponds to any of the chambers 106, 406, or 506 of FIG. 1, 4, or 5. The first signal 632 corresponds to the first signal 132 of FIG. 1, and corresponds to acoustic pressure in the chamber 106, 406, or 506 of FIG. 1, 4, or 5. The sensor corresponds to any of the sensors 118, 418, or 518 of FIG. 1, 4, or 5, respectively. The one or more circuits 600 are configured to process the first signal 632 to determine a magnitude of the first signal 632, and to compare the magnitude to the threshold (e.g., the threshold described with reference to the threshold signals 120, 420, or 520 of FIG. 1, 4, or 5) as described above to determine whether acoustic pressure within the chamber 106, 406, or 506 of FIG. 1, 4, or 5, satisfies the threshold. The threshold signal 620 corresponds to the threshold signal 120, 420, or 520 of FIG. 1, 4, or 5.

In some examples, the one or more circuits 600 include a rectifier/detector 634. In some examples, the rectifier/detector 634 is configured to convert the first signal 632 into a direct current (DC) signal 646 (e.g., a "rectified first signal"). In some examples, the rectified first signal 646 corresponds to acoustic pressure within the chamber 106, 406, or 506 of FIG. 1, 4, or 5. The rectifier/detector 634 can be any rectifier configured to convert the first signal 632 from alternating current (AC) to DC. In some examples, the rectifier/detector 634 includes diodes, mercury-arc valves, copper and selenium oxide rectifiers, semiconductor diodes, silicon-controlled rectifiers, and/or other silicon-based semiconductor switches.

The one or more circuits 600 include a low-pass filter 636 coupled to the rectifier/detector 634 to receive the rectified first signal 646. In some examples, the low-pass filter 636 is configured to filter the rectified first signal 646 to provide a comparison signal 648 corresponding to an amount of acoustic pressure within the chamber 106, 406, or 506 of FIG. 1, 4, or 5. In some examples, the comparison signal 648 is a substantially steady DC signal. In some examples, the low-pass filter 636 includes, for example, a resistor-capacitor (RC) circuit, a reservoir capacitor, a smoothing capacitor, a capacitor input filter, a voltage regulator circuit, or any combination thereof.

In some examples, the rectifier/detector 634 includes a peak detector (e.g., a full-wave peak detector), and the full-wave peak detector and the low-pass filter 636 are configured (alone or in combination with other circuitry [not illustrated]) to operate as an envelope follower 604 (e.g., a full-wave peak detector/envelope follower). In some examples, the envelope follower 604 (e.g., the full-wave peak detector) has a fast attack and a slower decay (e.g., the peak-detector's decay time is longer than the attack time). The envelope follower 604 exhibits a fast attack when the envelope follower 604 exhibits a temporally fast sweep from its resting frequency to the point of maximum sweep. Thus, when configured with a fast attack, the envelope follower 604 provides an envelope signal (e.g., the comparison signal 648) that responds quickly to changes in the input signal (e.g., the first signal 632 or a signal derived at least partially therefrom or in response thereto). Accordingly, when the envelope follower 604 has a fast attack, the envelope follower 604 is able to respond quickly enough to track envelope fluctuations corresponding to over-pressure disturbances. The envelope follower 604 exhibits slower decay when the envelope follower 604 takes a longer time to settle back to its resting level. In some examples, the other circuitry [not illustrated] is configured to augment the envelope follower using attack/decay circuitry [not illustrated] to provide the envelope follower 604 independent "attack" and "decay" times. In some examples, the output of the envelope follower 604 corresponds to the comparison signal 648.

In some examples, the peak detector includes a resistor-capacitor network that includes one or more capacitors [not illustrated] (e.g., peak detector capacitors) that are charged to a peak voltage and that are discharged through one or more resistors [not illustrated] (e.g., peak detector resistors). In some examples, the envelope follower 604 may include a buffer stage [not illustrated]. The buffer stage ensures that the one or more peak detector capacitors discharge through the one or more peak detector resistors. In some examples, the attack time may be shortened (e.g., made faster) by reducing a capacitance of the one or more peak detector capacitors.

The one or more circuits 600 include a comparator 638 coupled to the low-pass filter 636 to receive the comparison signal 648. The comparator 638 is also coupled to a reference source 621 that provides or applies a signal corresponding to the threshold (e.g., the threshold signal 620) to the comparator 638. In some example, the threshold signal 620 corresponds to the threshold signal 120 of FIG. 1. The comparator 638 is configured to compare the comparison signal 648 to the threshold signal 620 to determine whether acoustic pressure within the chamber satisfies the threshold. In some examples, the comparator 638 is configured to determine whether the acoustic pressure satisfies the threshold based on whether a value of a parameter (e.g., a voltage) of the comparison signal 648 is greater than (or greater than or equal to) a value of the parameter of the threshold signal 620. In some examples, as described above, satisfying the threshold is indicative of an over-pressure disturbance. In some examples, the threshold corresponds to a voltage of the threshold signal 620. In these examples, the comparison signal 648 satisfies (e.g., exceeds) the voltage when the earpiece experiences an over-pressure disturbance.

The comparator 638 is configured to output the control signal 642 based on whether the acoustic pressure in the chamber 106, 406, or 506 of FIG. 1, 4, or 5 satisfies the threshold. In some examples, the control signal 642 corresponds to a first control signal 642 when acoustic pressure within the chamber 106, 406, or 506 of FIG. 1, 4, or 5 satisfies the threshold. In some examples, the first control signal 642 corresponds to the open valve state, as described above. Alternatively or additionally, the control signal 642 corresponds to a second control signal 642 when acoustic pressure in the chamber does not satisfy the threshold. In some examples, the second control signal 642 corresponds to the closed valve state, as described above. The control signal 642 (or a signal at least partially derived therefrom or in response thereto) is applied to a valve to control the valve. In some examples, the control signal 642 (or the signal at least partially derived therefrom or in response thereto) is applied to one or more of the valves 104, 204, 304, 404, or 504 of FIG. 1, 2, 3, 4, or 5 to control the valves 104, 204, 304, 404, or 504 of FIG. 1, 2, 3, 4, or 5. In some examples, the control signal 642 is applied to one more switches or other electrical components configured to electrically couple the valve 104, 204, 304, 404, or 504 of FIG. 1, 2, 3, 4, or 5 to one or more energy sources when the first control signal 642 is asserted. When the valve 104, 204, 304, 404, or 504 of FIG. 1, 2, 3, 4, or 5 is electrically coupled to the one or more energy sources, actuation energy from the one or more energy sources is applied to the valve 104, 204, 304, 404, or 504 of FIG. 1, 2, 3, 4, or 5. When applied to the valve 104, 204, 304, 404, or 504 of FIG. 1, 2, 3, 4, or 5, the actuation energy energizes the valve 104, 204, 304, 404, or 504 of FIG. 1, 2, 3, 4, or 5, causing the valve 104, 204, 304, 404, or 504 of FIG. 1, 2, 3, 4, or 5 to open (or to remain in the open valve state).

In some examples, the control signal 642 is applied to an actuator drive amplifier [not illustrated], where the control signal 642 is processed (e.g., amplified). The processed control signal 642 is then applied to a valve actuator, such as the actuator 114 of FIG. 1, the solenoid 214 of FIG. 2A or 2B, the shape memory alloy wire 314 of FIG. 3A or 3B, or a piezoelectric actuator [not illustrated]. In these examples, the actuation energy 142 of FIG. 1, 442 of FIG. 4, or 542 of FIG. 5 corresponds to the processed control signal 642.

Figure 7:
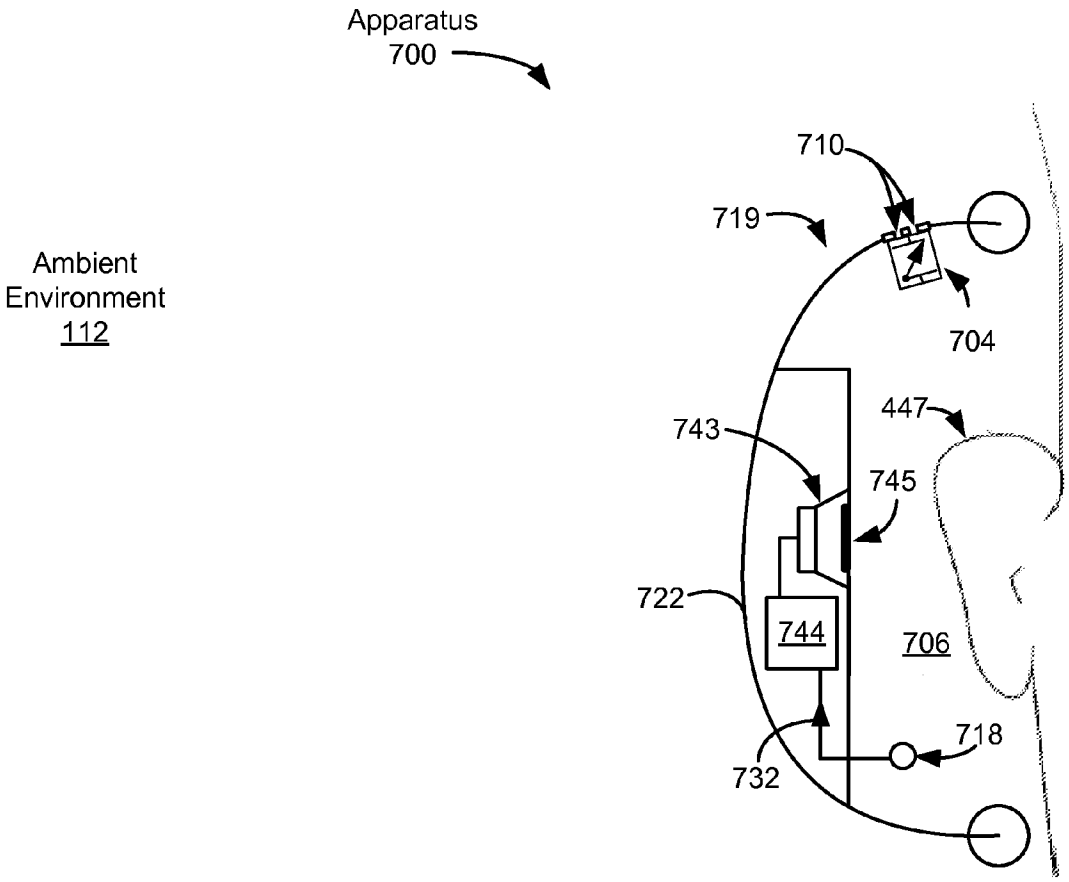
FIG. 7 is a diagram of an illustrative implementation of a passive pressure equalization apparatus.

With reference to FIG. 7, an apparatus that includes one or more passageways 710 formed in a housing 722 of an earcup 719 is generally depicted as 700. A sensor 718, a first signal 732, an ANR compensation and gain unit 744, and a speaker driver 743 may correspond to the sensor 118, the first signal 132, the ANR compensation and gain unit 144, and the speaker driver 143 of FIG. 1. The valve 704 is a passive valve. In some examples, the valve 704 is a check valve that, when open, enables fluid in the chamber 706 (e.g., the fluid 111 of FIG. 1) to pass through the one or more passageways 710 and out of the chamber 706. The one or more passageways 710 include one or more discontinuities, holes, orifices, passages, slits, ports, openings, or apertures. When unobstructed and/or open, the one or more passageways 710 enable the fluid within the chamber 106 to flow through the one or more passageways 710 and out of the chamber 706. In some examples, the valve 704 allows fluid within the chamber 706 to flow through the valve 704 into the ambient environment 112 (e.g., a forward or an upstream flow direction), but does not allow fluid from the ambient environment 112 to flow through the valve 704 into the chamber 706 (e.g., a reverse or a downstream flow direction). In some examples, the valve 704 is configured to allow the fluid to flow through the valve 704 in the upstream flow direction when a pressure in the chamber 706 (e.g., at an inlet of the valve 704) exceeds a particular pressure (e.g., a "cracking pressure"). Alternatively or additionally, the valve 704 is configured to prevent flow of the fluid through the valve 704 in either or both of the forward direction or the reverse direction when the cracking pressure is not exceeded.

In some examples, the cracking pressure corresponds to an over-pressure disturbance or state as described above. In these examples, the valve 704 is configured to experience or to be exposed to the cracking pressure when the earcup 719 experiences an over-pressure disturbance or state. Thus, in these examples, the valve 704 is configured to allow fluid within the chamber 706 to flow through the valve 704 in the forward direction responsive to an over-pressure disturbance, thereby relieving pressure within the chamber 706 in response to the over-pressure disturbance or state. Alternatively or additionally, the valve 704 is configured to not experience (or to not be exposed to) the cracking pressure when the earcup 719 is not experiencing an over-pressure disturbance or state. Thus, in these examples, the valve 704 is configured to not allow fluid to flow in either or both of the forward or the reverse flow directions when the earcup 719 is not experiencing an over-pressure disturbance or state, thereby sealing the one or more passageways 710 when the earcup 719 is not experiencing the over-pressure disturbance or state. Thus, in some examples, the valve 704 controls flow of the through one or more passageways 710 in a housing 722 of an earcup 719 based on whether the earcup 719 is experiencing an over-pressure disturbance or state.

Although FIG. 7 is illustrated without an active valve, it will be understood that the valve 704 can be used in conjunction with the active valve systems of FIGS. 1, 4, and 5. To illustrate, in some examples, one or more second passageways corresponding to the one or more passageways 710 is formed in the earpiece 108 of FIG. 1 or the earcups 419 or 519 of FIG. 4 or 5. The valve 704 is disposed proximate to the one or more second passageways and may operate in conjunction with one or more of the valves 104, 404, or 504 of FIG. 1, 4, or 5 to relieve pressure in one or more of the chambers 106, 406, or 506 of FIG. 1, 4, or 5.

Figure 8:
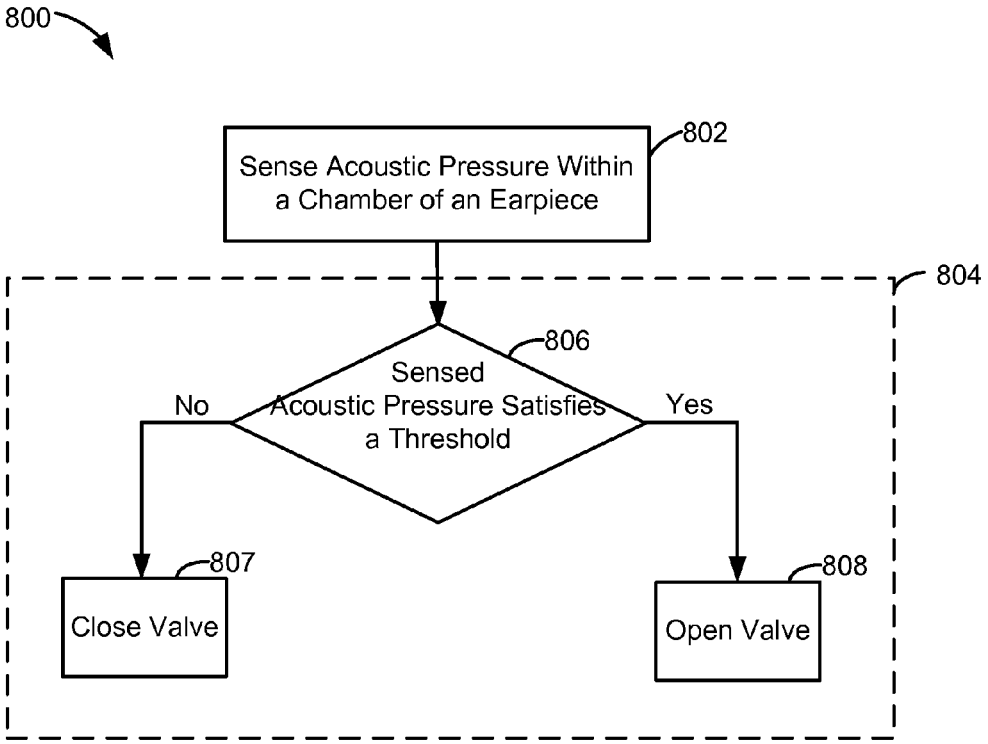
FIG. 8 is a flow chart of an illustrative implementation of a method of actively equalizing pressure within an earpiece.

FIG. 8 is a flowchart of an illustrative implementation of a method 800 of equalizing pressure within an earpiece. In some examples, the method 800 is performed using the apparatus 100, 200, 300, 400, 500, and/or the one or more circuits 600 of FIGS. 1-6, respectively. The method 800 includes sensing, at 802, acoustic pressure within a chamber of an earpiece. In some examples, the earpiece corresponds to one or more of the earpiece 108 of FIG. 1 or the earcups 419 or 519, of FIGS. 4 and 5, respectively. In some examples, the chamber corresponds to one or more of the chambers 106, 406, 506 of FIGS. 1, 4, 5, respectively. In some examples, the acoustic pressure within the chamber 106, 406, 506 of FIGS. 1, 4, 5 is sensed using a sensor, such as the sensor 118, 418, or 518 of FIG. 1, 4, or 5, as described above.

The method 800 includes regulating, at 804, acoustic pressure within the chamber 106, 406, or 506 of FIG. 1, 4, or 5 by controlling passage of a fluid (e.g., air) through a passageway based on the sensed acoustic pressure in the chamber 106, 406, or 506 of FIG. 1, 4, or 5, as described above. In some examples, the passageway corresponds to any of the passageways 110, 410, or 510 of FIG. 1, 4, or 5. The method 800 includes controlling passage of the fluid through the passageway using a valve. In some examples, the valve corresponds to the valve 104, 204, 304, 404, or 504 of FIGS. 1-5. In some examples, as described above, controlling passage of the fluid includes opening or unobstructing the one or more passageways 110, 410, or 510 of FIG. 1, 4, or 5 by an amount proportional to the sensed acoustic pressure in the chamber 106, 406, or 506 of FIG. 1, 4, or 5. In some examples, the one or more passageways 110, 410, or 510 of FIG. 1, 4, or 5 are opened or unobstructed by an amount proportional to the sensed acoustic pressure in the chamber 106, 406, or 506 of FIG. 1, 4, or 5 by using a metering or proportional valve as described above. In other examples, as described above, controlling passage of the fluid includes opening or unobstructing the one or more passageways 110, 410, or 510 of FIG. 1, 4, or 5 using a two-state valve as described above.

In some examples, regulating, at 804, acoustic pressure within the chamber 106, 406, or 506 of FIG. 1, 4, or 5 includes determining, at 806, whether acoustic pressure within the chamber 106, 406, or 506 of FIG. 1, 4, or 5 satisfies a threshold, as described above. In some examples, satisfying the threshold is indicative of occurrence of an over-pressure disturbance, as described above. In some examples, the determining, at 806, is performed using one or more circuits, such as the one or more circuits 116, 416, 516, or 600 of FIG. 1, 4, 5, or 6 as described above. In some examples, the method 800 determines whether the sensed acoustic pressure satisfies the threshold by receiving the first signal 132, 432, or 532 of FIG. 1, 4, or 5, processing the first signal 132, 432, or 532 of FIG. 1, 4, or 5 as described above (e.g., with reference to FIG. 6), and comparing the processed first signal 132, 432, or 532 of FIG. 1, 4, or 5 with the threshold (e.g., one or more of the threshold signals 120, 220, 320, 420, 520, or 620 of FIGS. 1-6) as described above. Thus, in some examples, the method 800 determines or detects, at 804, the occurrence of an overpressure disturbance in the chamber 106, 406, or 506 of FIG. 1, 4, or 5.

The method 800 includes opening or unobstructing, at 808, the one or more passageways 110, 410, or 510 of FIG. 1, 4, or 5 by opening the valve 104, 204, 304, 404, or 504 of FIGS. 1-5 in response to determining that the sensed acoustic pressure within the chamber 106, 406, or 506 of FIG. 1, 4, or 5 satisfies the threshold as described above. The method 800 includes closing or obstructing, at 807, the one or more passageways 110, 410, or 510 of FIG. 1, 4, or 5 by closing the valve in response to determining that the sensed acoustic pressure within the chamber 106, 406, or 506 of FIG. 1, 4, or 5 does not satisfy the threshold. Thus, in some examples, the method 800 includes opening the one or more passageways 110, 410, or 510 of FIG. 1, 4, or 5 during occurrence of an over-pressure disturbance, and includes closing the one or more passageways 110, 410, or 510 of FIG. 1, 4, or 5 when an over-pressure disturbance is not being experienced.

Thus, in some examples, pressure built up in the chamber 106, 406, or 506 of FIG. 1, 4, or 5 in response to an over-pressure disturbance is detected based on information from the sensor as processed by the valve control assembly. The built up pressure is then relieved by opening the one or more passageways 110, 410, or 510 of FIG. 1, 4, or 5, enabling fluid (e.g., air) to flow through the one or more passageways 110, 410, or 510 of FIG. 1, 4, or 5. Closing the one or more passageways 110, 410, or 510 of FIG. 1, 4, or 5 when there is no overpressure condition, as described above, reduces environmental noise within the earpiece, thereby supporting attempts to passively reduce noise, and enables effective introduction of noise cancellation pressure into the earpiece, thereby supporting active noise reduction techniques.

Figure 9:
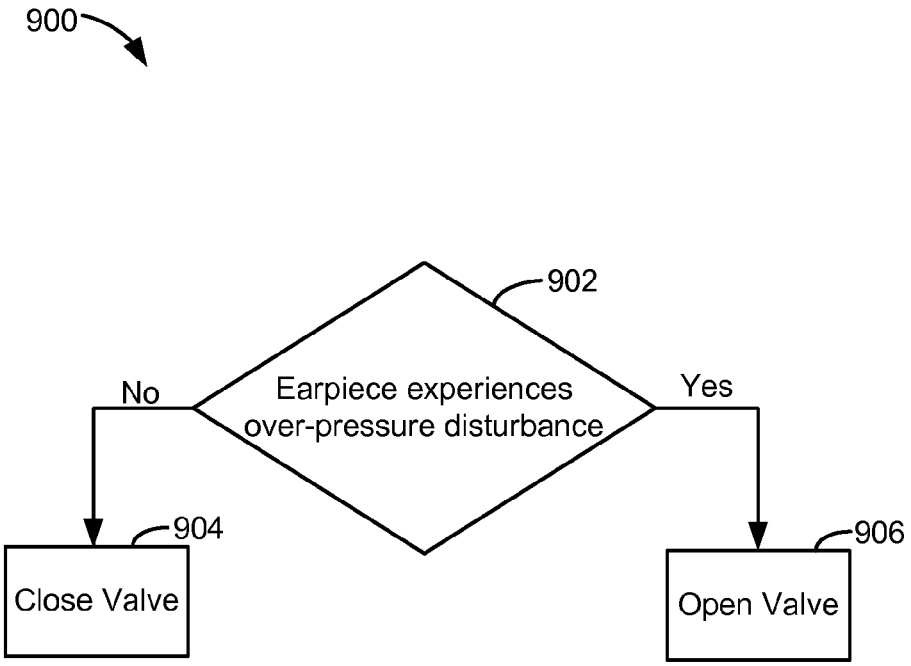
FIG. 9 is a flow chart of an illustrative implementation of a method of passively equalizing pressure within an earpiece.

FIG. 9 is a flowchart of an illustrative implementation of a method 900 of equalizing pressure within an earpiece. In some examples, the method 900 is performed using the apparatus 700 of FIG. 7. The method 900 includes opening, at 906, the valve 704 of FIG. 7 in response to an over-pressure disturbance, and closing the valve 704, at 904, when the earpiece is not experiencing an over-pressure disturbance. In some examples, the valve 704 determines, at 902, whether the earpiece is experiencing an over pressure disturbance based on whether pressure in the chamber 706 (e.g., applied to the inlet of the valve 704) exceeds the cracking pressure of the valve.

In some examples, implementations of the apparatus and techniques described above include computer components and computer-implemented steps that will be apparent to those skilled in the art. In some examples, one or more of the first signals 132, 432, 532, 632, or 732 of FIG. 1, 4, 5, 6, or 7; one or more of the control signals 191, 243, 343; or one or more of the threshold signals 120, 420, 520, or 620 include a digital signal. In some examples, one or more of the valves 104, 404, or 504 of FIG. 1, 4, or 5 are digitally controlled valves, and the steps described with reference to FIG. 1, 4, 5, 6, or 8 are performed by a processor executing instructions from a memory. For example, as described above, a valve positioner is configured to receive the first signal 132, 432, or 532 of FIG. 1, 4, or 5 from a sensor (e.g., the sensor 118, 418, or 518 of FIG. 1, 4, or 5) and to convert or relate the first signal 132, 432, or 532 to a valve position (e.g., a "determined valve position"). The positioner is configured to output a digital control signal to move the valve to the determined valve position.

It should be understood by one of skill in the art that the computer-implemented steps can be stored as computer-executable instructions on a computer-readable medium such as, for example, floppy disks, hard disks, optical disks, flash memory, nonvolatile memory, and RAM. In some examples, the computer-readable medium is a computer memory device that is not a signal. Furthermore, it should be understood by one of skill in the art that the computer-executable instructions can be executed on a variety of processors such as, for example, microprocessors, digital signal processors, gate arrays, etc. For ease of description, not every step or element of the systems and methods described above is described herein as part of a computer system, but those skilled in the art will recognize that each step or element can have a corresponding computer system or software component. Such computer system and/or software components are therefore enabled by describing their corresponding steps or elements (that is, their functionality) and are within the scope of the disclosure.

Those skilled in the art can make numerous uses and modifications of and departures from the apparatus and techniques disclosed herein without departing from the inventive concepts. For example, components or features illustrated or describe in the present disclosure are not limited to the illustrated or described locations. As another example, examples of apparatuses in accordance with the present disclosure can include all, fewer, or different components than those described with reference to one or more of the preceding figures. The disclosed examples should be construed as embracing each and every novel feature and novel combination of features present in or possessed by the apparatus and techniques disclosed herein and limited only by the scope of the appended claims, and equivalents thereof.

What is claimed is:

1. A headphone apparatus comprising:

a speaker having a diaphragm;

an earpiece comprising a chamber, the chamber having a passageway, wherein the chamber is configured to be at least partially bounded by the diaphragm and an ear of a user when the earpiece is worn by the user;

a valve in the earpiece configured to relieve acoustic pressure in the chamber; and a valve control assembly configured to control the valve based on sensed acoustic pressure in the chamber, wherein the valve is configured to open to relieve the acoustic pressure in the chamber when the acoustic pressure in the chamber exceeds a threshold.

2. The apparatus of claim 1, wherein the valve is a two-position valve having an at-rest state and an actuated state, wherein in the at-rest state, the valve is configured to seal the passageway, and wherein in the actuated state, the valve is configured to enable passage of air through the passageway.

3. The apparatus of claim 1, wherein the valve control assembly is configured to control a size of an opening to the chamber made by the valve by an amount proportional to the sensed acoustic pressure in the chamber.

4. The apparatus of claim 1, wherein the passageway is in an inner earpiece barrier that separates the chamber from a second chamber of the earpiece.

5. The apparatus of claim 4, wherein a housing of the earpiece comprises an equalization port between the second chamber and an ambient environment, wherein, when open, the valve is configured to enable passage of air between the chamber and the second chamber, and wherein the equalization port is configured to enable the air to flow between the second chamber and the ambient environment.

6. The apparatus of claim 1, wherein the valve control assembly is configured to close the valve when the sensed acoustic pressure is below the threshold.

7. The apparatus of claim 1, wherein the valve control assembly is configured to detect an over-pressure disturbance when the sensed acoustic pressure in the chamber exceeds the threshold.

8. The apparatus of claim 6, further comprising a sensor configured to provide, to the valve control assembly, a first signal corresponding to the sensed acoustic pressure in the chamber.

9. The apparatus of claim 8, wherein the valve control assembly further comprises a valve actuator associated with the valve, and wherein the valve control assembly is configured to actuate the valve actuator based on the first signal.

10. The apparatus of claim 9, wherein the valve actuator comprises a solenoid, a piezoelectric member, a shape memory actuator, or a combination thereof.

11. The apparatus of claim 9, wherein the valve control assembly comprises circuitry coupled to the sensor and coupled to the valve actuator, the circuitry configured to receive the first signal, wherein the circuitry comprises a comparator configured to output a first control signal when the sensed acoustic pressure in the chamber exceeds the threshold and a second control signal when the sensed acoustic pressure in the chamber does not exceed the threshold.

12. The apparatus of claim 11, wherein the valve actuator is an electrically driven actuator, wherein the valve control assembly is configured to energize the electrically driven actuator when the comparator outputs the first control signal, and wherein the valve control assembly is configured to not energize the electrically driven actuator when the comparator outputs the second control signal.

13. The apparatus of claim 11, wherein the circuitry further comprises a rectifier and a low pass filter, the rectifier coupled to the sensor and coupled to the low pass filter, and the low pass filter coupled to the comparator, and wherein the rectifier is configured to receive the first signal.

14. The apparatus of claim 11, wherein the circuitry further comprises an envelope follower comprising a full-wave peak detector, the full-wave peak detector having an attack time and a decay time, wherein the decay time is longer than the attack time.

15. A method, comprising:

at an earpiece that comprises a chamber and a valve associated with a passageway, the valve located within the earpiece and the chamber configured to be at least partially bounded by a diaphragm of a speaker located within the earpiece and by an ear of a user when worn by the user, performing:

sensing acoustic pressure within the chamber; and regulating acoustic pressure within the chamber via the valve by controlling passage of a fluid through the passageway based on the acoustic pressure, wherein the valve opens to relieve the acoustic pressure in the chamber in response to the acoustic pressure in the chamber exceeding a threshold.

16. The method of claim 15, wherein regulating the acoustic pressure comprises controlling a size of an opening to the chamber made by the valve by an amount proportional to the acoustic pressure.

17. The method of claim 15, wherein the passageway is through a body of the earpiece that separates the chamber from an ambient environment.

18. The method of claim 15, wherein the passageway is through an inner earpiece barrier that separates the chamber from a second chamber bound by a body of the earpiece and the inner earpiece barrier.

19. The method of claim 15, wherein regulating the acoustic pressure within the passage comprises closing the passageway by closing the valve in response to determining that the acoustic pressure is less than the threshold.

20. The method of claim 15, wherein the threshold is indicative of an over-pressure disturbance.

21. The method of claim 15, further comprising determining whether the acoustic pressure exceeds the threshold by receiving a first signal from a sensor disposed within the earpiece, processing the first signal, and comparing the processed first signal to a signal corresponding to the threshold.

* * * * *